United States Patent [19]

Gorse

[11] 4,452,293

[45] Jun. 5, 1984

[54] FOLDING DOOR

[76] Inventor: Paul Gorse, 133 Queen St., E., Mississauga, Ontario, Canada, L5G 1N1

[21] Appl. No.: 469,206

[22] Filed: Feb. 24, 1983

Related U.S. Application Data

[63] Continuation of Ser. No. 174,704, Jul. 28, 1980, abandoned, which is a continuation of Ser. No. 003,247, Jan. 15, 1979, abandoned.

[30] Foreign Application Priority Data

Jan. 20, 1978 [CA] Canada ..... 295350

[51] Int. Cl.[3] ..... E06B 3/16

[52] U.S. Cl. ..... 160/232

[58] Field of Search ..... 160/232, 236, 201

[56] References Cited

U.S. PATENT DOCUMENTS

| | | | |
|---|---|---|---|
| 2,926,727 | 3/1960 | Purdy | 160/232 X |
| 3,104,699 | 9/1963 | Wolf et al. | 160/232 X |
| 3,110,936 | 11/1963 | Berard | 49/92 |
| 3,247,637 | 4/1966 | Robertson | 160/232 X |
| 3,980,123 | 9/1976 | Vago | 160/232 X |
| 4,037,639 | 7/1977 | Jones | 160/232 X |

FOREIGN PATENT DOCUMENTS

| | | | |
|---|---|---|---|
| 1384844 | 11/1964 | France | 160/232 |

*Primary Examiner*—Philip C. Kannan

*Attorney, Agent, or Firm*—Fetherstonhaugh & Co.

[57] ABSTRACT

Folding doors of the type commonly used as garage doors have to date had very unsatisfactory thermal insulation characteristics. The folding door of the present invention has improved thermal insulation characteristics derived from the use of a thermal insulating panel which comprises a body of plastics material having a series of closely adjacent passages extending transversely between opposite edges thereof. The passages are air filled and are isolated from one another over the full width of the insulating panel. Opposite ends of the passages are closed by closure means at opposite side edges of the panels so as to form a plurality of totally enclosed pockets extending horizontally of the door and thereby provide panels having high thermal insulation ratings.

2 Claims, 4 Drawing Figures

FOLDING DOOR

This application is a continuation of my copending application Ser. No. 174,704, filed July 28, 1980, now abandoned, which application was a continuation of application Ser. No. 003,247, filed Jan. 15, 1979, now abandoned. Priority based on priority papers filed in Ser. No. 003,247 is claimed under 35 U.S.C. 119.

This invention relates to an improved thermal insulating panel for use in a folding door, and a folding door including such a panel.

A folding door of the type to which the present invention relates is described in U.S. Pat. No. 3,104,699, dated Sept. 24, 1963.

With the ever increasing energy costs, the need for good thermal insulation in a folding door construction such as those used in garages and the like has become increasingly important.

I have found that a folding door having good thermal insulation characteristics can be constructed by employing thermal insulating panels consisting of two layers of polycarbonate material spaced from one another by transversely extending ribs. A suitable material is identified by the trade mark "Microlon S.D.P." and is available from Chemacryl Plastics Limited, Toronto, Ontario.

In my preliminary investigations into the use of panels constructed from this material, I was advised by the technical representatives of the manufacturer that the panels constructed from this material and having air passages formed therein were not suitable for use in the application which I contemplated, namely, as an insulating panel in a folding door such as a garage door. I was advised that panels of this construction should be used in applications in which the passages which are formed in the panels are vertically oriented so as to provide adequate drainage for condensation which will accumulate in the passages in use and to ensure adequate strength of the section under load conditions.

Despite the technical advice of the experts in this field, I constructed a garage door with the panels arranged so that the air passages extend transversely thereof and, contrary to the opinion of the experts whose advice I sought initially, I find that a very satisfactory folding door can be constructed with the panels oriented so that the passages extend transversely thereof in a horizontal plane. I have found that the difficulties of condensation can be overcome by closing the ends of the passages to form enclosed pockets during the assembly operation and by assembling the panels in a dry atmosphere.

According to one aspect of the present invention, there is provided in a folding door of the type having a plurality of horizontally oriented sections hingedly connected to one another so as to articulate with respect to one another during opening and closing of said door, the improvement wherein each of said sections comprises a frame and a thermal insulating panel mounted in said frame, said thermal insulating panel comprising a body of plastics material having a series of closely adjacent air filled passages extending transversely between opposite side edges thereof, said air filled passages being isolated from one another over the full width of the insulating panel between said opposite side edges, and closure means at said opposite side edges for closing the ends of said passages so as to form a plurality of totally enclosed air filled pockets extending horizontally of said door and thereby provide panels having a high thermal insulation rating.

The invention will be more clearly understood after reference to the following detailed specification read in conjunction with the drawings, wherein FIG. 1 is a partially sectioned pictorial view of an insulating panel constructed in accordance with one embodiment of the present invention;

Figure 1:
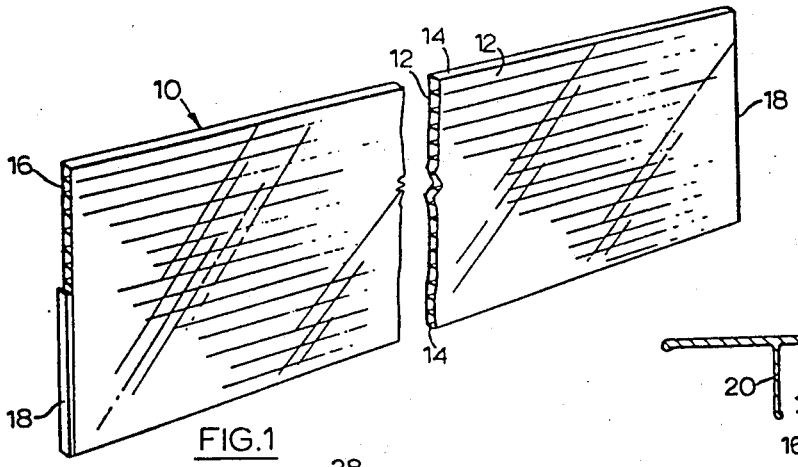
Figure 4:
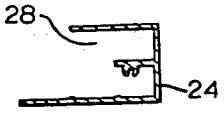
FIG. 4 is a sectional view of a side frame member of the door taken along the line 4—4 of FIG. 2.

As previously indicated, an overhead door of the general type to which the present invention relates is described in U.S. Pat. No. 3,104,699, with the result that the present specification does not include complete details of all of the hardware of the door assembly.

With reference to the drawings, the reference numeral 10 refers generally to a thermal insulating panel which consists of a pair of planar sheets 12 of plastics material spaced from one another by a plurality of transversely extending ribs 14 of plastics material. A plurality of passages 16 are formed in the panel and extend from one end to the other. A panel of a suitable construction is the Mincrolon S.D.P. (Trade Mark) double-skin sheet available from Chemacryl Plastics Limited. This material is generally translucent and has a heat transfer index of 553 BTU/sq. ft. h°F.

In order to overcome condensation difficulties, I close opposite ends of the passage 16 by narrow panels 18 which are preferably made from plastics material similar to the plastics material from which the remainder of the panel is constructed, The pockets formed by the closing of the ends of the passages 16 extend from end to end of the panel and are isolated from one another. Panels 18 are adhesively secured or otherwise bonded so as to close the ends of the passages 16. In the construction of the panels, I have found that it is advantageous to provide a dry atmosphere in which to perform the operation of securing the end panels 18 so that the air within the pockets has a low moisture content.

Each of the panels 10 is located in a frame which includes a top rail member 20, a bottom rail 22 and a pair of oppositely disposed side rails 24.

The frame is preferably constructed from extruded aluminum or the like. Each of the frame members is formed with a channel 28 which is adapted to receive an edge of the panel 10. A layer of insulating material 30 is located about the periphery of each panel 10 so as to be interposed between each panel 10 and the frame.

Figure 2:
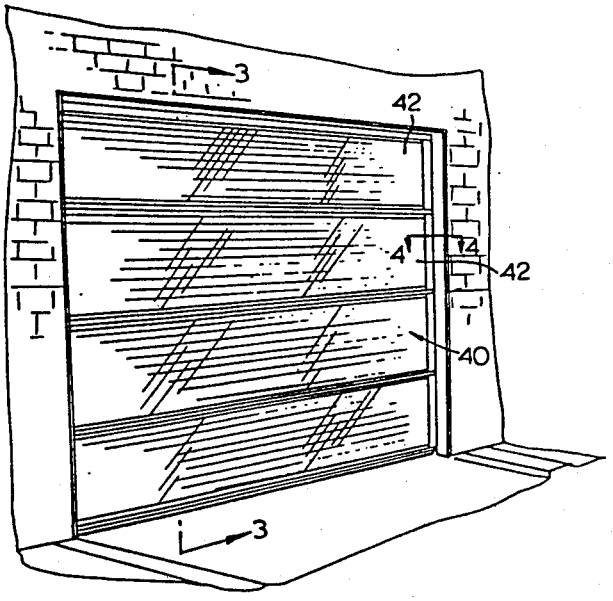
FIG. 2 is a front view of a typical folding door according to one aspect of the present invention.
Figure 3:
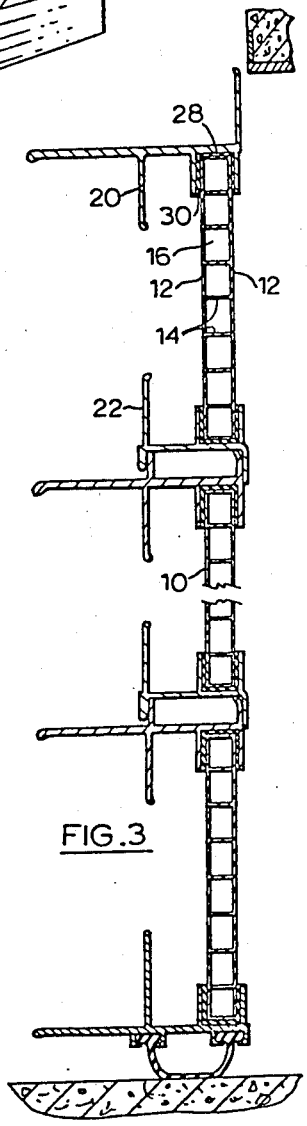
FIG. 3 is a sectional view of a door along the line 3—3 of FIG. 2.

FIG. 2 of the drawings illustrates a folded door generally identified by the reference numeral 40 which consists of a plurality of door sections 42 which are hingedly connected to one another so that the air filled pockets of each of the insulating panels extend transversely between opposite sides of the door.

The sections 42 of the door are hingedly connected to one another substantially as described in U.S. Pat. No. 3,104,699 so that the door may be opened by raising the door so that it folds along a suitable guide track to be located in an overhead position when open.

I have found that a door constructed in accordance with the present invention has good thermal insulation properties and strength characteristics. By constructing the panels 10 from a translucent material, light may enter the building through the door.

What I claim as my invention is:

1. An articulated overhead garage-type door having improved thermal insulation properties, the door including plural horizontally oriented door sections hingedly connected to one-another and each section extending the full width of the door, each door section comprising:

(a) a rectangular open frame including top and bottom horizontally disposed rails extending the full width of the door and opposed vertical side rails, the rails having similar mutually aligned channel portions of rectangular cross-section facing inwardly of the frame;

(b) a thermal insulating panel of plastic material supported in the frame and extending transversely from one side of the door to the other, the panel comprising two opposed mutually-parallel planar sheets spaced from one-another and joined by a plurality of integrally formed closely adjacent ribs extending parallel to the top and bottom rails from one side of the door to the other and forming within the panel plural air passages, and the panel including two vertically disposed closure means bonded to the side edges of the panel and sealing the air passages to form mutually-isolated totally enclosed air pockets, the planar sheets and the closure means forming a flat rigid panel of uniform external thickness and of rectangular cross-section receivable within the channel portions of the rails; and (c) a layer of insulating material in each channel portion interposed between the rail and the panel.

2. A door as claimed in claim 1, wherein the thermal insulating panel is made of translucent plastic material.

* * * * *